US006240680B1

(12) United States Patent
Estes

(10) Patent No.: US 6,240,680 B1
(45) Date of Patent: Jun. 5, 2001

(54) AUTOMATIC DOWNSPOUT DRAIN EXTENSION

(76) Inventor: Luther Roy Estes, Rte. 1, Box 12, Russell St., Jonesville, VA (US) 24263

( * ) Notice: Subject to any disclaimer, the term of this patent is extended or adjusted under 35 U.S.C. 154(b) by 0 days.

(21) Appl. No.: 09/510,067

(22) Filed: Feb. 22, 2000

(51) Int. Cl.[7] ..... E04D 13/08

(52) U.S. Cl. ..... 52/16; 52/11; 137/615

(58) Field of Search ..... 52/11, 16; 137/615, 137/44, 357, 358, 579, 873, 874

(56) References Cited

U.S. PATENT DOCUMENTS

| | | | | |
|---|---|---|---|---|
| 3,316,928 | * | 5/1967 | Weakley | 137/119.06 |
| 3,375,851 | * | 4/1968 | Henry et al. | 137/396 |
| 3,911,954 | * | 10/1975 | Johnson | 137/615 |
| 4,270,572 | | 6/1981 | Jarzynka . | |
| 5,014,745 | * | 5/1991 | Watt | 52/16 X |
| 5,358,006 | * | 10/1994 | Sweers | 52/16 X |
| 5,358,007 | * | 10/1994 | Carlberg | 52/16 X |
| 5,452,743 | * | 9/1995 | Rortvedt | 52/16 X |
| 5,482,084 | * | 1/1996 | Cassidy et al. | 137/615 |
| 5,511,829 | | 4/1996 | Sicotte et al. . | |
| 5,522,427 | | 6/1996 | Johnson . | |
| 5,673,519 | | 10/1997 | McCaughan . | |
| 5,735,085 | | 4/1998 | Denooy . | |

* cited by examiner

*Primary Examiner*—Beth A. Stephan
*Assistant Examiner*—Brian E. Glessner
(74) *Attorney, Agent, or Firm*—Pitts & Brittian, P.C.

(57) ABSTRACT

An automatic downspout drain extension that automatically deploys into a downward position upon the weight of an entrained column of fluid. The automatic downspout drain extension includes a downspout member that depends from a gutter and is secured to a wall of a structure to which the gutter is mounted. The terminal end of the downspout is connected to a flexible elbow having a first end and a second end. The flexible elbow is secured between the downspout and the extension member. The extension member is an elongated conduit that includes an energy dissipater carried by the distal end of the extension member. The energy dissipater includes a liquid absorbing insert. A spring member biases the extension member in the upright position. As water flowing off of the roof exits the gutter and flows into the downspout, the downspout and extension member simultaneously fill with water until the weight of the column of water in the extension member overcomes the biasing force of the spring member and allows the extension member to deploy downward. Water flowing from the extension member saturates the liquid absorbing insert. The weight of the saturated liquid absorbing insert is sufficient to overcome the biasing force of the spring member, thus maintaining the extension member in the folded down, or deployed, position.

5 Claims, 3 Drawing Sheets

AUTOMATIC DOWNSPOUT DRAIN EXTENSION

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to a downspout for guttering systems. More particularly, it relates to an automatically deployed downspout drain extension.

2. Description of the Related Art

Gutters have long been used to divert the flow of water, such as rain water or snow melt, off of the roof of a structure. Typically, gutters direct the flow of water to one or more downspouts, which themselves direct the flow of water away from the base of the building. Generally, the downspout directs the flow of water towards a splash block or other means of channeling the flow of water away from the base of the building. Often it is desirable to direct the flow of water farther from the base of the building. To this end, various extensions have been developed in the art. Typical of these devices are those disclosed in the following U.S. Letter Patents:

| Patent Number | Inventor Name | Issue Date |
|---|---|---|
| 4,270,572 | Jarzynka | June 2, 1981 |
| 5,511,829 | Sicotte, et al. | April 30, 1996 |
| 5,522,427 | Johnson | June 4, 1996 |
| 5,673,519 | McCaughan | Oct. 7, 1997 |
| 5,735,085 | Denooy | April 7, 1998 |

In this regard, the extensions are either manually deployed and require a latch mechanism, or are of complex construction.

Accordingly, there is a need for a downspout drain extension that is automatically deployable, automatically retracts upon cessation of the flow of water and is of simple construction.

It is therefore an object of the present invention to provide a downspout drain extension that is automatically deployable.

It is a further object of the present invention to provide a downspout drain that automatically retracts subsequent to the cessation of the flow of water.

Another object of the present invention is to provide an automatic downspout drain extension that is of simple construction with relatively few moving parts so as to be substantially free from risk of being fouled by debris.

Other objects and advantages over the prior art will become apparent to those skilled in the art upon reading the detailed description together with the drawings as described as follows.

BRIEF SUMMARY OF THE INVENTION

In accordance with the teachings of the present invention an automatic downspout drain extension, having advantages over the prior art, is disclosed. The automatic downspout drain extension includes a downspout member that depends from a gutter and is secured to a wall of a structure to which the gutter is mounted. The terminal end of the downspout is connected to a flexible elbow having a first end and a second end. The first end of the flexible elbow is secured to the terminal end of the downspout by any conventional method of securing two conduits so as to form a liquid tight joint. The second end of the elbow is similarly secured to the extension member. In this regard, the extension member is an elongated conduit that includes an energy dissipater carried by the distal end of the extension member. The energy dissipater has a rigid shell frame and a liquid absorbing insert. A spring member, operatively engaged with the downspout and the extension member, biases the extension member in the upright position such that the extension member is substantially parallel to the downspout. As water flowing off of the roof exits the gutter and flows into the downspout, the downspout and extension member simultaneously fill with water. When the weight of the column of water in the extension member is sufficient to overcome the biasing force of the spring member, the extension member deploys downward and allows water to flow from the extension member. As water flows from the extension member, the liquid absorbing insert in the energy dissipater becomes saturated. The weight of the saturated liquid absorbing insert is sufficient to overcome the biasing force of the spring member, thus maintaining the extension member in the folded down, or deployed, position.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 2:
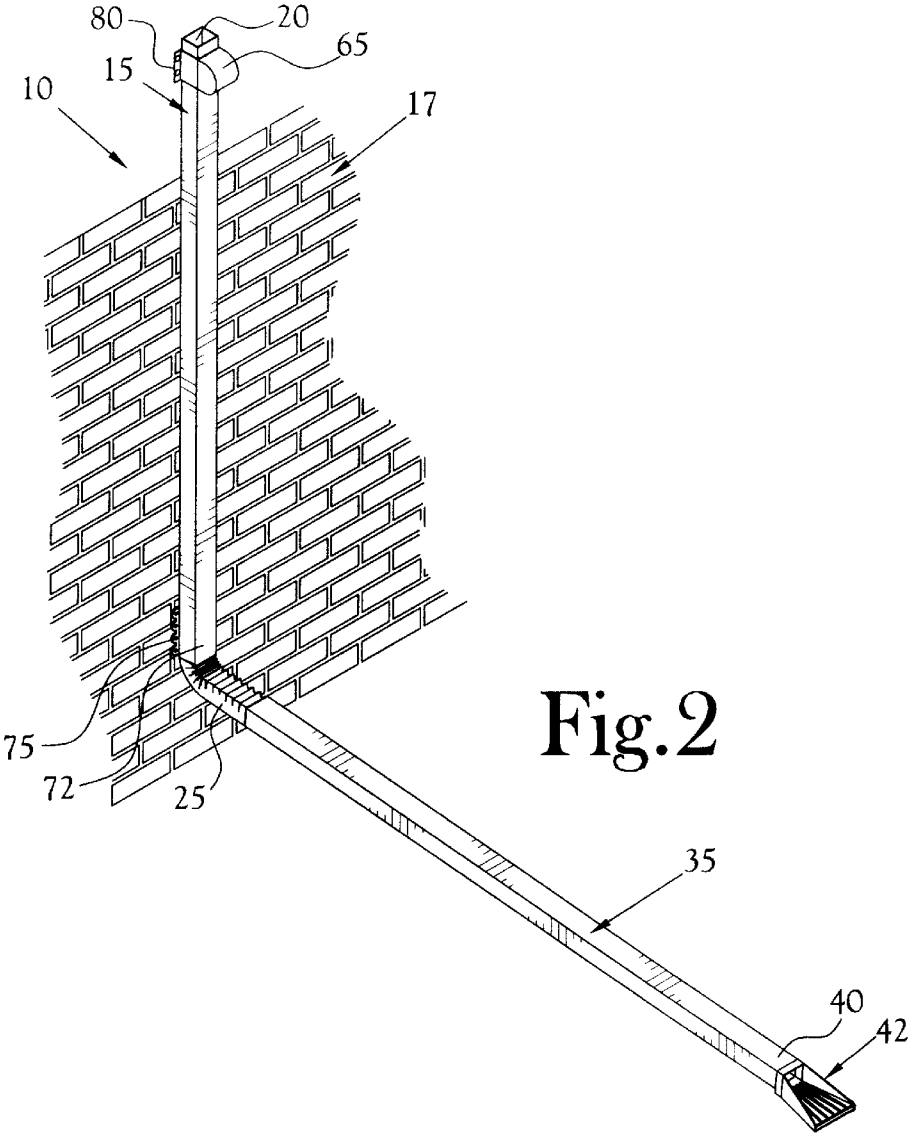
FIG. 2 illustrates a perspective view of the present invention showing the extension member of the downspout in the folded down, or deployed, position.

An automatic downspout drain extension, constructed in accordance with the present invention, is illustrated generally as 10 in the figures. The automatic downspout drain extension 10 includes a downspout member 15 that depends from a gutter (not shown), a flexible elbow member 25 and an extension member 35. The downspout member 15 is secured to a wall 17 of a structure to which the gutter is mounted. The downspout 15 includes a first end 20 for receiving fluid, such as rainwater, snow melt or other fluids that typically flow from a roof of a structure, from the gutter and a terminal end 22.

Figure 3A:
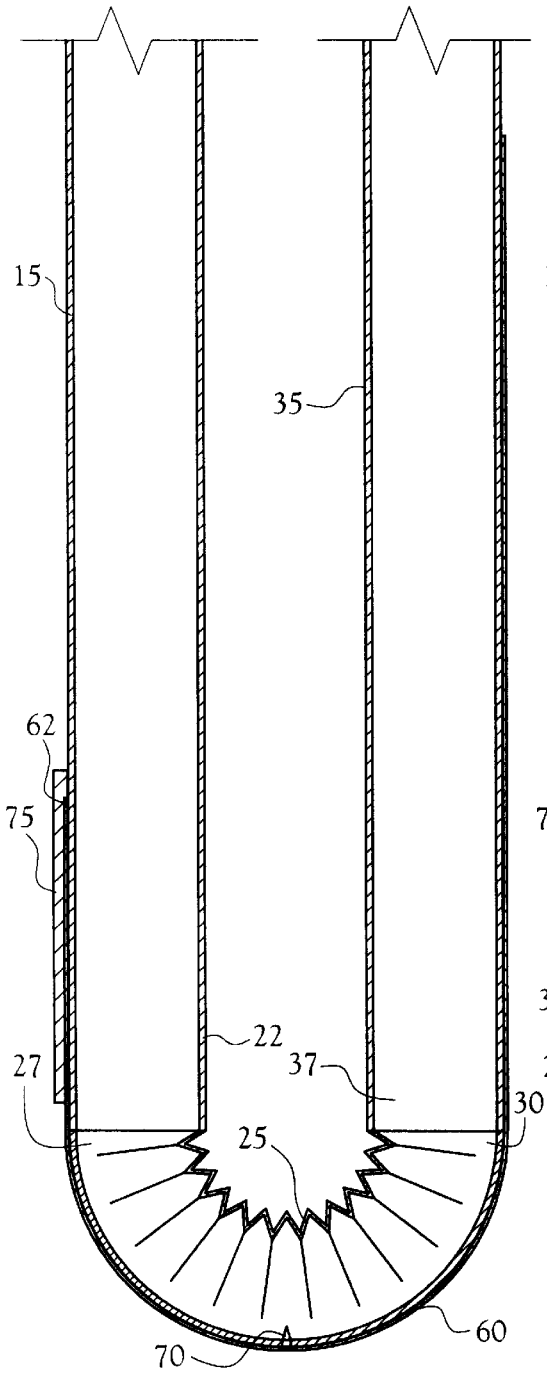
FIG. 3*a* illustrates a partial cross-sectional view of one embodiment of the present invention.
Figure 3B:
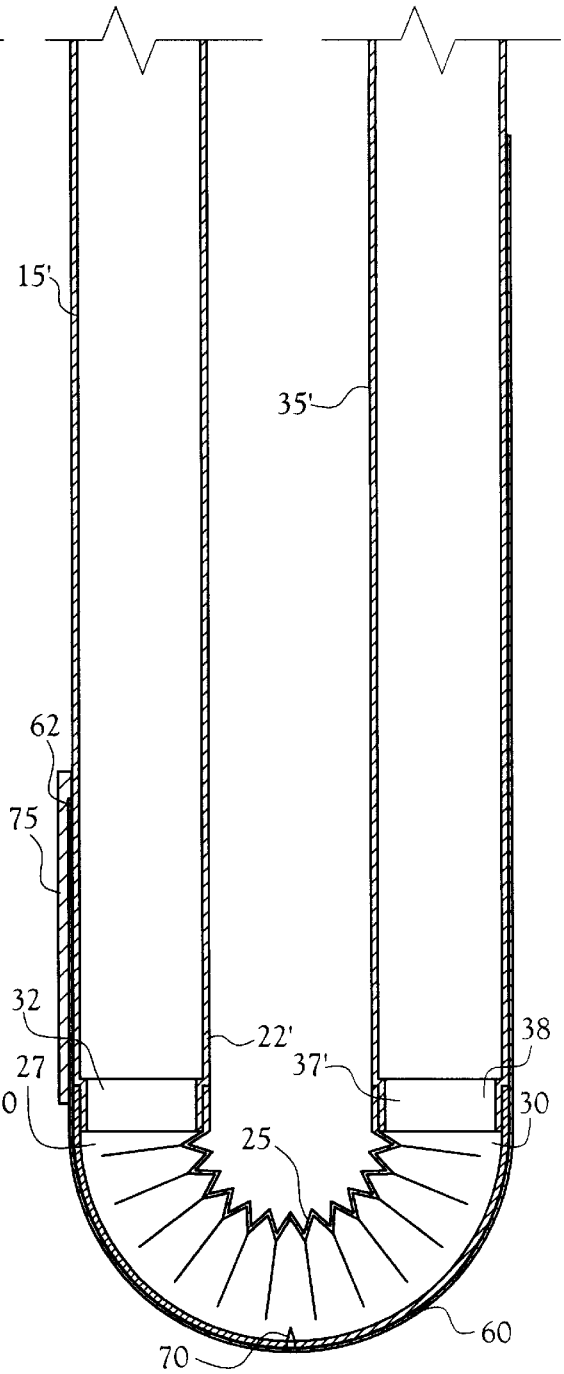
FIG. 3*b* illustrates a partial cross-sectional view of an alternate embodiment of the present invention.
Figure 4:
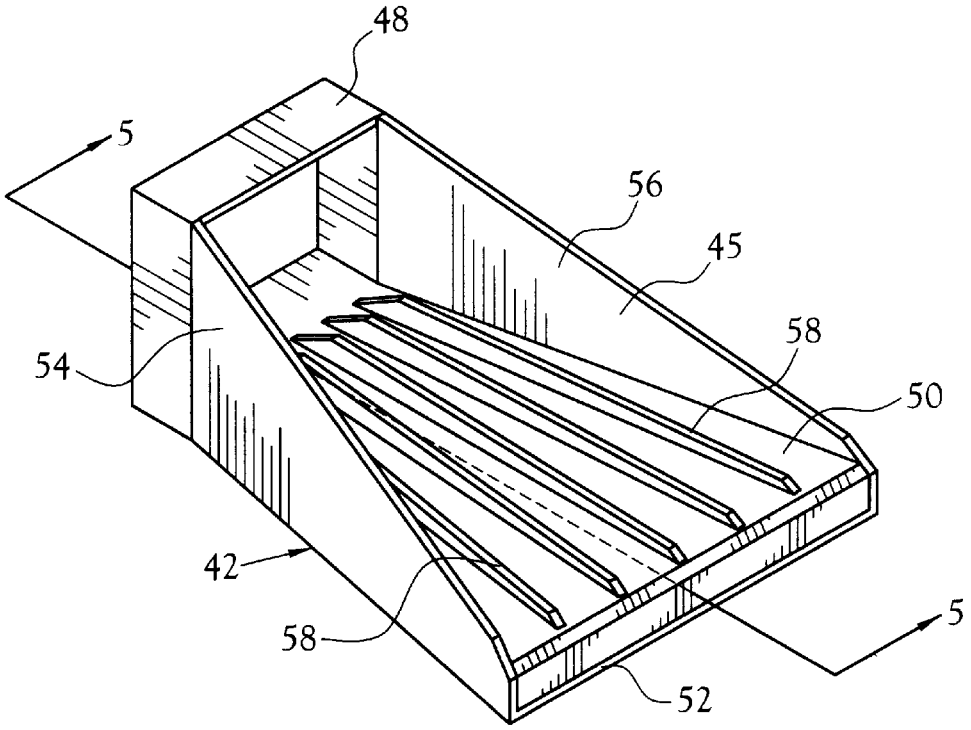
FIG. 4 illustrates partial perspective view of the energy dissipater of the sent invention.
Figure 5:
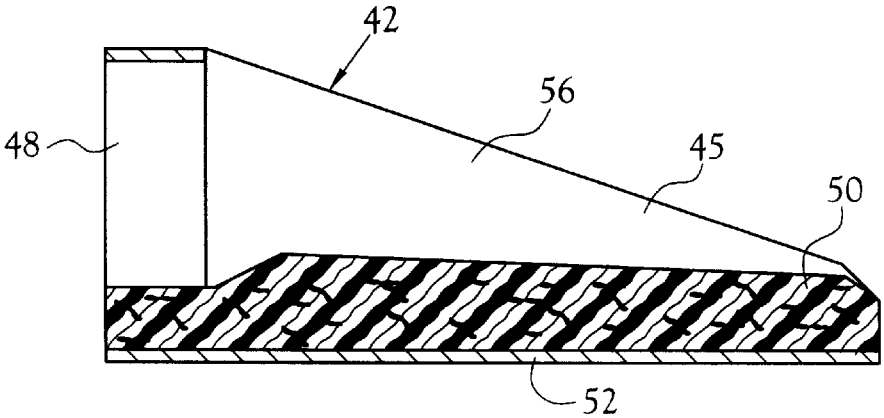
FIG. 5 illustrates a cross-sectional view of the energy dissipater of the present invention taken at line 5—5 in FIG. 4.

The terminal end 22 of the downspout 15 is connected to a flexible elbow member 25 having a first end 27 and a second end 30. The first end 27 of the flexible elbow 25 is secured to the terminal end 22 of the downspout 15 by any conventional method of securing two conduits so as to form a liquid tight joint. As illustrated in FIG. 3*a*, the first end 27 of the flexible elbow 25 can be secured directly to the terminal end 22 of the downspout 15 by bonding or by being integral with the terminal end 22. In an alternate embodiment illustrated in FIG. 3*b*, the terminal end 22' of the downspout 15' can include a region 32 having reduced interior dimensions adapted to be received within the first end 27 of the elbow member 25. The extension member 35 has a first end 37 secured to the second end 30 of the elbow member 25 in similar fashion. In this regard, in the alternate embodiment illustrated in FIG. 3*b*, the first end 37' of the extension member 35' includes a region 38 having reduced interior dimensions adapted to be received within the second end 30 of the elbow member 25. In the preferred embodiment, the flexible elbow member 25 is constructed of a heavy duty, semi-rigid material such as rubber and is corrugated to allow the elbow member to flex through a range of motion that exceeds 90°.

The extension member 35 is an elongated conduit for conveying fluid away from the base of the structure and, in addition to having a first end 37 secured to the second end 30 of the elbow member 25, has a distal end 40. An energy dissipater 42 is carried by the distal end 40 of the extension member 35. The energy dissipater 42 has a rigid shell frame 45 that includes a collar member 48. The energy dissipater 42 further includes a liquid absorbing insert 50. In this regard, the rigid shell frame 45 defines a conduit, having a substantially open top, a floor 52 and opposed side members 54 and 56. In the preferred embodiment, the side members 54 and 56 are non-parallel and flare outward from the collar member 48. Moreover, the liquid absorbing insert 50 includes at least one, and preferably a plurality of ribs 58 for diffusing the flow of fluids.

Figure 1:
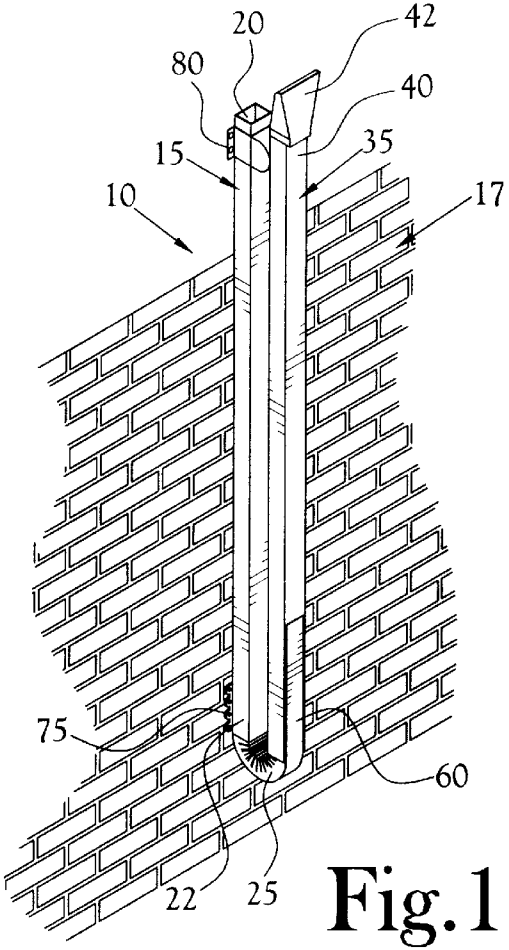
FIG. 1 illustrates a perspective view of the present invention showing the tension member of the downspout in the upright, or non-deployed, position.

A spring member 60 is operatively engaged with the downspout 15 and the extension member 35 so as to bias the extension member 35 in an upright position, illustrated in FIG. 1, such that the extension member 35 is substantially parallel to the downspout 15. A bumper 65, carried by the downspout 15 proximate the first end 20, serves to bias the extension member 35 away from the downspout 15 when the extension member is in the upright position. As water flowing off of the roof exits the gutter and flows into the downspout 15, the downspout 15 and extension member 35 simultaneously fill with water. When the weight of the column of water in the extension member 35 is sufficient to overcome the biasing force of the spring member 60, the extension member 35 deploys downward, to the position illustrated in FIG. 2, and allows water to flow from the extension member 35. As water flows from the extension member 35, the liquid absorbing insert 50 in the energy dissipater 42 becomes saturated with water. The weight of the saturated liquid absorbing insert 50 is sufficient to overcome the biasing force of the spring member 60, thus maintaining the extension member in the folded down, or deployed, position. Upon cessation of fluid flow through the extension member, the liquid absorbing insert 50 begins to dry, both through the evaporative process and through drainage, thus reducing the weight of the liquid absorbing insert 50 and the biasing force of the spring member 60 returns the extension member 35 to the upright position. The bumper 65 is preferably constructed of a resilient shock absorbing material so as to absorb the shock of the impact of the extension member 35 against the bumper 65.

In the preferred embodiment, the flexible elbow member 25 is provided with a small weep hole 70. The weep hole 70 allows condensate, such as dew, to slowly drip from the elbow member 25 during times when the extension member is in the upright position. Further, in the preferred embodiment, the first end 62 of the spring member 60 is received by the lower bracket 75. Lower bracket 75 and an upper bracket 80 secure the downspout 15 to the wall 17. As can be seen and appreciated by those skilled in the art, the automatic downspout drain extension 10 operates with a minimum of moving parts and has no moving parts that can be fouled or jammed by the type of debris that is typically found on roofs and in gutters. In the preferred embodiment, the downspout 15 and the extension member 35 have substantially equal lengths. However, those skilled in the art will appreciate that the extension member 35 could either be substantially longer than, or substantially shorter than, downspout 15 depending upon the distance away from the base of the structure that a user wishes to disperse the fluid.

From the foregoing description, it will be recognized by those skilled in the art that an automatic downspout drain extension offering advantages over the prior art has been provided. Specifically, the automatic downspout drain extension provides a downspout drain extension that is automatically deployable, that automatically retracts subsequent to the cessation of the flow of water, and that is of simple construction with relatively few moving parts so as to be substantially free from risk of being fouled by debris.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, we claim:

1. An automatically deployable downspout drain extension comprising;

a downspout member defined by a fluid conveying conduit for conveying fluid away from a gutter, said downspout member being securable to a wall and including a first end securable to a gutter and a terminal end;

a flexible elbow member having a first end and a second end, said first end being secured to said terminal end of said downspout member in a substantially fluid tight joint;

an extension member defined by a fluid conveying conduit having a first end and a second end, wherein said first end is secured to said second end of said flexible elbow member in a substantially fluid tight joint;

a spring member operatively engaged with said extension member, said spring member having a biasing force sufficient to bias said extension member into an upwards orientation such that said extension member is substantially parallel with said downspout member; and an energy dissipater carried by said second end of said extension member, said energy dissipater including a liquid absorbing member, wherein said liquid absorbing member has a saturated weight sufficient to overcome said biasing force of said spring member.

2. The automatically deployable downspout drain extension of claim 1 wherein said automatically deployable downspout drain extension further comprises a weep hole disposed in said flexible elbow member.

3. The automatically deployable downspout drain extension of claim 1 wherein said automatically deployable downspout drain extension further comprises a bumper carried by said first end of said downspout member for biasing said second end of said extension member away from said first end of said downspout.

4. The automatically deployable downspout drain extension of claim 1 wherein said automatically deployable downspout drain extension further comprises a plurality of brackets for securing said downspout to a wall.

5. The automatically deployable downspout drain extension of claim 1 wherein said fluid absorbing member of said energy dissipater includes at least one rib for diffusing a flow of a fluid.

* * * * *